US007152259B1

(12) United States Patent
Goodwin

(10) Patent No.: US 7,152,259 B1
(45) Date of Patent: Dec. 26, 2006

(54) TOP SHEET/BLANKET EXTENDERS

(76) Inventor: Barbara Goodwin, 19847 Parthenia St., Northridge, CA (US) 91324

( * ) Notice: Subject to any disclaimer, the term of this patent is extended or adjusted under 35 U.S.C. 154(b) by 105 days.

(21) Appl. No.: 10/918,176

(22) Filed: Aug. 12, 2004

Related U.S. Application Data

(60) Provisional application No. 60/495,590, filed on Aug. 15, 2003.

(51) Int. Cl.
*A47G 9/04* (2006.01)

(52) U.S. Cl. ..... 5/496; 5/498; 5/923; 5/925

(58) Field of Classification Search ..... 5/496–498, 5/504.1, 692, 923, 925, 926
See application file for complete search history.

(56) References Cited

U.S. PATENT DOCUMENTS 2,210,210 A * 8/1940 Kisilew ..... 5/501
2,507,091 A * 5/1950 Carlson ..... 24/72.5
3,083,378 A * 4/1963 Pursell ..... 5/498
3,501,787 A * 3/1970 Nunn ..... 5/496
3,832,743 A * 9/1974 Smith ..... 5/496
3,857,124 A * 12/1974 Hadley ..... 5/496
4,301,561 A * 11/1981 McLeod ..... 5/496
4,389,744 A * 6/1983 Monroe ..... 5/498
4,488,323 A * 12/1984 Colburn ..... 5/692
4,615,061 A * 10/1986 Scott ..... 5/497
4,658,454 A * 4/1987 Potter ..... 5/497
5,020,177 A * 6/1991 Etherington ..... 5/496
5,027,456 A * 7/1991 Wadsworth ..... 5/424
5,134,736 A * 8/1992 Anthony et al. ..... 5/496
5,327,595 A * 7/1994 Allen ..... 5/692
5,557,814 A 9/1996 Cybulski
5,794,285 A 8/1998 Burch
5,946,751 A 9/1999 DeMay

* cited by examiner

*Primary Examiner*—Robert G. Santos

(57) ABSTRACT

An apparatus for use with a bed and bed sheet combination is disclosed. The apparatus is an extender sheet to be used in combination with an existing top sheet on a bed, with the extender sheet being removably attached to the top sheet. The purpose of the extender sheet is to make sure that the top sheet would not be removed, or become "untucked," during a sleeping period of an individual using a bed.

10 Claims, 2 Drawing Sheets

TOP SHEET/BLANKET EXTENDERS

I. CROSS-REFERENCE TO RELATED APPLICATIONS

This application claims the benefit of U.S. Provisional Application No. 60/495,590, filed Aug. 15, 2003.

II. BACKGROUND OF THE INVENTION

The present invention concerns that of a new and improved apparatus for use with a bed and bed sheet combination.

III. DESCRIPTION OF THE PRIOR ART

U.S. Pat. No. 5,946,751, issued to DeMay, discloses a means for retaining bedding articles comprised of a plurality of Velcro fasteners attached to the skirt and matching fasteners attached with adhesive to the sheet.

U.S. Pat. No. 5,794,285, issued to Burch, discloses a bed covering comprised of a top sheet with elastic attachment sections provided along the perimeter and includes Velcro fasteners.

U.S. Pat. No. 5,557,814, issued to Cybulski, discloses an upper bed sheet with an extending sidewall at the foot end and includes a two-part hook and loop fastener.

IV. SUMMARY OF THE INVENTION

The present invention concerns that of a new and improved apparatus for use with a bed and bed sheet combination. The apparatus would be an extender sheet to be used in combination with an existing top sheet on a bed, with the extender sheet being removably attached to the top sheet. The purpose of the extender sheet would be to make sure that the top sheet would not be removed, or become "untucked," during a sleeping period of an individual using a bed.

There has thus been outlined, rather broadly, the more important features of a bedding apparatus that the detailed description thereof that follows may be better understood and in order that the present contribution to the art may be better appreciated. There are, of course, additional features of the bedding apparatus that will be described hereinafter and which will form the subject matter of the claims appended hereto.

In this respect, before explaining at least one embodiment of the bedding apparatus in detail, it is to be understood that the bedding apparatus is not limited in its application to the details of construction and to the arrangements of the components set forth in the following description or illustrated in the drawings. The bedding apparatus is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present bedding apparatus. It is important, therefore, that the claims be regarded as including such equivalent constructions insofar as they do not depart from the spirit and scope of the present invention.

It is therefore an object of the present invention to provide a bedding apparatus which has all of the advantages of the prior art and none of the disadvantages.

It is another object of the present invention to provide a bedding apparatus which may be easily and efficiently manufactured and marketed.

It is another object of the present invention to provide a bedding apparatus which is of durable and reliable construction.

It is yet another object of the present invention to provide a bedding apparatus which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
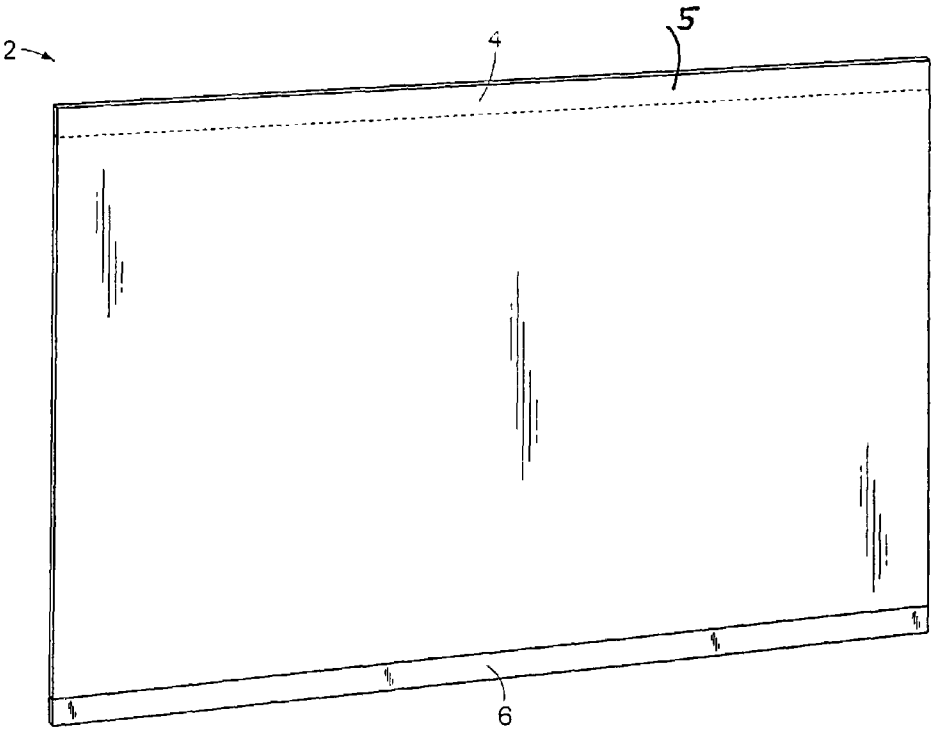
FIG. 1 shows a side perspective view of the extender sheet of the present invention.

FIG. 1 shows a side perspective view of the extender sheet 2 of the present invention. Extender sheet 2 has two surfaces, a top surface and a bottom surface, and would have a rectangular shape. Extender sheet 2 would also have two ends comprising a first end and a second end and would also have two side edges comprising a first side edge and a second side edge.

Extender sheet 2 would have a strip of attachment material 4 attached to the first side edge of the extender sheet 2 on the first surface of the extender sheet 2. The strip of attachment material 4 would traverse the entire length of the side edge to which it would be attached and would have a first plurality of attachment objects 5 on it. The strip of attachment material 4 would preferably be about one to two inches in width and would be half of a "hook and loop" attachment system that requires two complementary patches to be removably attached to one another.

Extender sheet 2 would also have a rubber strip 6 attached to the second side edge of the extender sheet 2. Rubber strip 6 preferably is about one to two inches in width.

Figure 2:
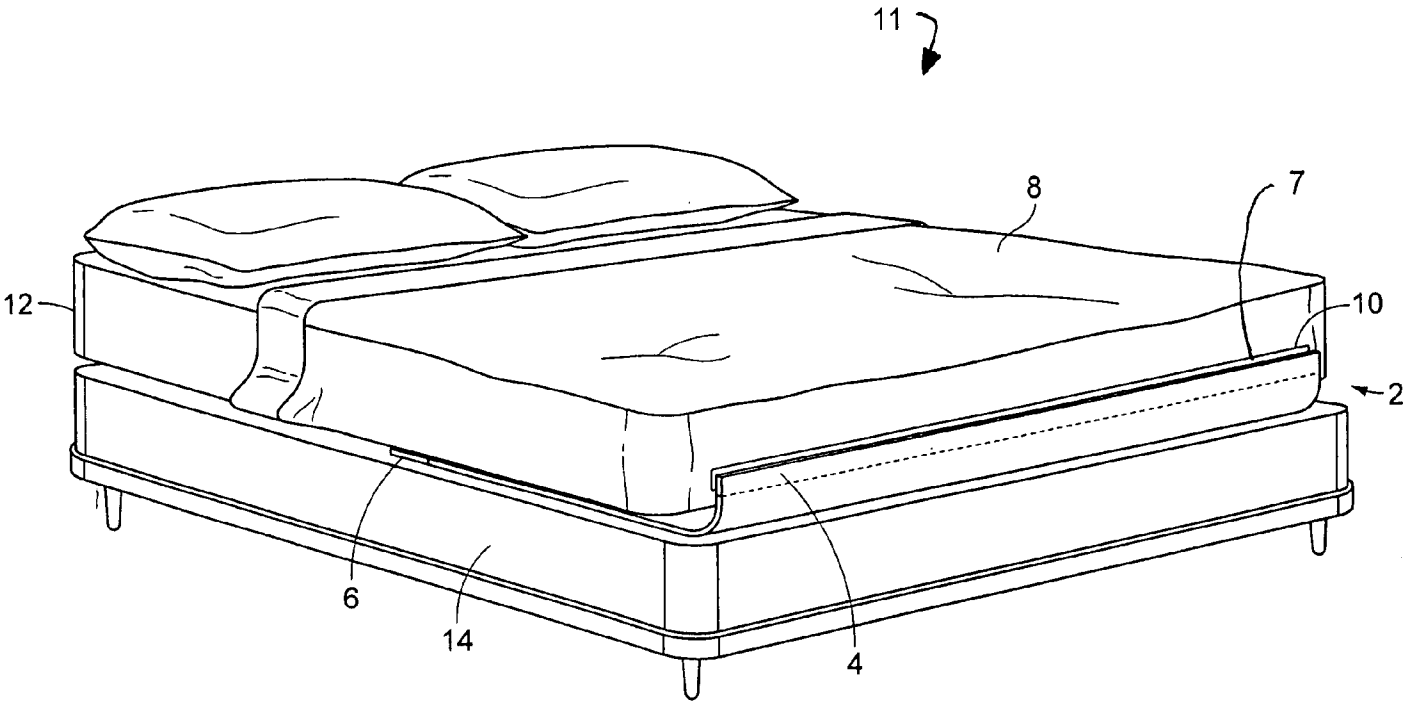
FIG. 2 shows the present invention as it would appear in use in combination with an existing sheet on a bed.

FIG. 2 shows the present invention as it would appear in use in combination with an existing sheet 8 on a bed 11. Sheet 8 would be a top sheet and would have a strip of attachment material 10 that would complement strip of attachment material 4, with strip of attachment material 10 having a second plurality of attachment objects 7 on it. Strip of attachment material 10 and strip of attachment material 4 would be the two required patches of a "hook and loop" patch system, sometimes known by the trademarked name VELCRO. Between the first plurality of attachment objects 5 and the second plurality of attachment objects 7, one of the pluralities is a plurality of hooks and the other plurality is a plurality of loops.

As can be seen in FIG. 2, extender sheet 2 would be placed in between mattress 12 and box springs 14, with the first surface of extender sheet 2 facing upward. The mattress 12 is located on top of the box springs 14. Then, strip of attachment material 10 would be placed into contact with strip of attachment material 4, thereby removably attaching the extender sheet 2 to the sheet 8. Next, the remaining portion of the extender sheet 2 is placed in between the mattress 12 and the box springs 14. Rubber strip 6 would provide added protection to ensure that the sheet 8 would not become untucked at night during use. Even if the extender sheet 2 was pulled out somewhat, it would still likely be tucked in, ensuring that the user would still be able to use sheet 8 in the regular manner for the rest of the sleeping period.

Extender sheet 2 would preferably be eighteen (18) inches in width, with the width dimension being measured from the first side edge to the second side edge and the length dimension being measured from the first end to the second end. The length of the extender sheet 2 would vary, depending on the size of mattress it would be used with. The length of the extender sheet 2 is preferably designed to be sixty (60) inches for a king-sized mattress, fifty-six (56) inches for a queen-sized mattress, and twenty-six (26) inches for a twin-sized mattress.

I claim:

1. An extension apparatus in combination with a top sheet for a bed, the bed including a box spring and a mattress wherein the mattress lies on the top of the box spring, a fitted sheet positioned about the mattress, the top sheet positioned upon the fitted sheet, a user entering between the top sheet and the fitted sheet, the extension apparatus comprising:

an extender sheet having a top surface, a bottom surface, a first end, a second end, a first side edge, and a second side edge, the extender sheet having a width less than the width of the mattress and a width less than the width of the top sheet, a first strip of attachment material attached to the first side edge of the extender sheet on the first surface of the extender sheet, the first strip of attachment material traversing the entire width of the first side edge, and a second strip of attachment material attached to the top sheet, wherein the first strip of attachment material and the second strip of attachment material are removably attached to one another, wherein the remaining portion of the extender sheet not attached to the top sheet is tucked in between the mattress and the box spring; and wherein the mattress and box springs are free from attachment material.

2. An extension apparatus in combination with a top sheet for a bed according to claim 1, wherein the first strip of attachment material further comprises a first plurality of attachment objects, and further wherein the second strip of attachment material further comprises a second plurality of attachment objects.

3. An extension apparatus in combination with a top sheet for a bed according to claim 2 wherein the first plurality of attachment objects is a plurality of hooks and the second plurality of attachment objects is a plurality of loops.

4. An extension apparatus in combination with a top sheet for a bed according to claim 2 wherein the first plurality of attachment objects is a plurality of loops and the second plurality of attachment objects is a plurality of hooks.

5. An extension apparatus in combination with a top sheet for a bed according to claim 1 wherein the extension apparatus further comprises a rubber strip attached to the second side edge of the extender sheet.

6. An extension apparatus in combination with a top sheet for a bed according to claim 5 wherein the rubber strip has a width between one to two inches.

7. An extension apparatus in combination with a top sheet for a bed according to claim 1 wherein the length of the extender sheet is eighteen (18) inches.

8. An extension apparatus in combination with a top sheet for a bed according to claim 7 wherein the width of the extender sheet is twenty-six (26) inches.

9. An extension apparatus in combination with a top sheet for a bed according to claim 7 wherein the width of the extender sheet is fifty-six (56) inches.

10. An extension apparatus in combination with a top sheet for a bed according to claim 7 wherein the width of the extender sheet is sixty (60) inches.

* * * * *